US007881629B2

(12) United States Patent
Takeuchi et al.

(10) Patent No.: US 7,881,629 B2
(45) Date of Patent: Feb. 1, 2011

(54) IMAGE FORMING APPARATUS AND IMAGE DENSITY CONTROL METHOD

(75) Inventors: Nobutaka Takeuchi, Kanagawa (JP); Hitoshi Ishibashi, Kanagawa (JP); Kohta Fujimori, Kanagawa (JP); Kayoko Tanaka, Tokyo (JP); Yushi Hirayama, Kanagawa (JP); Naoto Watanabe, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 478 days.

(21) Appl. No.: 11/932,198

(22) Filed: Oct. 31, 2007

(65) Prior Publication Data

US 2008/0124107 A1 May 29, 2008

(30) Foreign Application Priority Data

Nov. 10, 2006 (JP) ..... 2006-305494
Dec. 28, 2006 (JP) ..... 2006-353780
Apr. 5, 2007 (JP) ..... 2007-099054

(51) Int. Cl.
*G03G 15/10* (2006.01)
*G03G 15/08* (2006.01)

(52) U.S. Cl. ..... 399/59; 399/27; 399/255; 399/258

(58) Field of Classification Search ..... 399/24, 399/27, 29, 30, 53, 58–60, 255, 258
See application file for complete search history.

(56) References Cited

U.S. PATENT DOCUMENTS 6,768,879 B2 * 7/2004 Kosuge ..... 399/53

(Continued)

FOREIGN PATENT DOCUMENTS

JP 57-136667 8/1982

(Continued)

OTHER PUBLICATIONS

U.S. Appl. No. 11/748,090, filed May 14, 2007, Nobutaka Takeuchi, et al.

(Continued)

*Primary Examiner*—David M Gray
*Assistant Examiner*—Joseph S Wong
(74) *Attorney, Agent, or Firm*—Oblon, Spivak, McClelland, Maier & Neustadt, L.L.P.

(57) ABSTRACT

In an image forming apparatus and an image density control method that are capable of suppressing the amount of toner consumed for a purpose other than image formation and responding to variation in the development ability of a development device due to environmental variation and the like such that a constant image density is obtained, the image density is maintained at a substantially fixed level by first target output value correcting means in accordance with a toner replacement amount and without consuming toner, and adjustment of the image density accompanying variation in the development ability due to environmental variation and the like is dealt with by second target output value correcting means in accordance with a toner pattern detection result. Hence, the frequency with which the toner pattern is detected in order to maintain the image density at a fixed level can be reduced in comparison with a case in which the image density is maintained at a fixed level on the basis of the toner pattern detection result alone, and as a result, the toner consumption amount can be suppressed.

12 Claims, 12 Drawing Sheets

U.S. PATENT DOCUMENTS

| | | | | |
|---|---|---|---|---|
| 2006/0239701 | A1* | 10/2006 | Ishibashi | 399/30 |
| 2007/0009289 | A1 | 1/2007 | Muramatsu et al. | |
| 2007/0065164 | A1 | 3/2007 | Fujimori et al. | |
| 2007/0081835 | A1 | 4/2007 | Tsuda et al. | |
| 2007/0086797 | A1 | 4/2007 | Watanabe | |
| 2007/0098423 | A1 | 5/2007 | Hirayama et al. | |
| 2007/0104499 | A1 | 5/2007 | Ariizumi et al. | |
| 2007/0110455 | A1 | 5/2007 | Ariizumi et al. | |
| 2007/0110457 | A1* | 5/2007 | Kato et al. | 399/30 |
| 2007/0110480 | A1 | 5/2007 | Matsumoto et al. | |
| 2007/0116480 | A1 | 5/2007 | Takeuchi et al. | |
| 2007/0116483 | A1 | 5/2007 | Kobayashi et al. | |
| 2007/0122168 | A1 | 5/2007 | Tanaka et al. | |
| 2007/0122169 | A1* | 5/2007 | Shimizu et al. | 399/27 |
| 2007/0122171 | A1 | 5/2007 | Fujimori et al. | |
| 2007/0223946 | A1 | 9/2007 | Watanabe | |
| 2007/0230979 | A1 | 10/2007 | Hasegawa et al. | |

FOREIGN PATENT DOCUMENTS

| | | |
|---|---|---|
| JP | 2-34877 | 2/1990 |
| JP | 8-202137 | 8/1996 |
| JP | 9-236983 | 9/1997 |
| JP | 11-174753 | 7/1999 |
| JP | 2005-331720 | 12/2005 |

OTHER PUBLICATIONS

U.S. Appl. No. 11/733,918, filed Apr. 11, 2007, Shinji Kato, et al.
U.S. Appl. No. 11/761,763, filed Jun. 12, 2007, Kayoko Tanaka, et al.

* cited by examiner

FIG. 9

| MOVING AVERAGE VALUE OF IMAGE AREA RATIO [%] | ΔTC [wt%] | ΔVtref [V] |
|---|---|---|
| M(i)<1 | 0.5 | −0.15 |
| 1≦M(i)<2 | 0.4 | −0.12 |
| 2≦M(i)<3 | 0.3 | −0.09 |
| 3≦M(i)<4 | 0.2 | −0.06 |
| 4≦M(i)<6 | 0.0 | 0.00 |
| 6≦M(i)<7 | −0.1 | 0.03 |
| 7≦M(i)<8 | −0.2 | 0.06 |
| 8≦M(i)<9 | −0.3 | 0.09 |
| 9≦M(i)<10 | −0.4 | 0.12 |
| 10≦M(i)<20 | −0.5 | 0.15 |
| 20≦M(i)<30 | −0.6 | 0.18 |
| 30≦M(i)<40 | −0.7 | 0.21 |
| 40≦M(i)<50 | −0.8 | 0.24 |
| 50≦M(i)<60 | −0.9 | 0.27 |
| 60≦M(i)<70 | −1.0 | 0.30 |
| 70≦M(i)<80 | −1.0 | 0.30 |
| 80≦M(i) | −1.0 | 0.30 |

IMAGE FORMING APPARATUS AND IMAGE DENSITY CONTROL METHOD

BACKGROUND OF THE INVENTION

1. Field of the Invention

The present invention relates to an image forming apparatus such as a copier, printer, or facsimile device for forming an image using a two-component developer constituted by a toner and a magnetic carrier, and an image density control method.

2. Description of the Related Art

A two-component development system in which a two-component developer (to be referred to hereafter simply as "developer") constituted by a toner and a magnetic carrier is held on a developer carrier, the developer is used to form a magnetic brush by means of a magnetic pole provided in the interior of the developer carrier, and development is performed by sliding the magnetic brush over a latent image formed on a latent image carrier is known widely in the related art. The two-component development system is used widely due to the ease with which color images can be formed thereby. In the two-component development system, background staining and a reduction in detail resolution may occur on a formed image when the toner concentration, i.e. the ratio (for example, the weight ratio) between the toner and the magnetic carrier in the developer is too high. When the toner concentration is too low, on the other hand, the density of the solid image portion may decrease, and the carrier may adhere to the latent image carrier. It is therefore important to perform toner concentration control to detect the toner concentration of the developer in a development device and control a toner replenishment operation so that the toner concentration of the developer is always within an appropriate range.

Furthermore, it is generally important to perform image formation in an image forming apparatus such that a constant image density is obtained at all times. The image density is principally determined according to the development ability of the development device. The development ability is determined according to the amount of toner that can be adhered to a latent image during development, and varies according to the toner concentration, development conditions such as the development potential, which is the potential difference between the latent image on the surface of the latent image carrier and the development carrier surface to which a developing bias is applied, and the charge of the toner that contributes to development. The incline (development $\gamma$) of a relational expression indicating the toner adhesion amount relative to the development potential is widely used as an index of the development ability. Since the image density is determined according to the development ability of the development device, the image density cannot be fixed simply by performing toner concentration control such that the toner concentration is always within an appropriate range, as described above. Moreover, although development conditions such as the development potential can be fixed comparatively easily, it is difficult to fix the charge of the toner that contributes to development. Hence, even if the development conditions are fixed and toner concentration control is performed to fix the toner concentration, the development ability cannot be fixed, and therefore a constant image density cannot be obtained.

More specifically, when an image with a low image area ratio is output, for example, the amount of toner consumed during development is comparatively low, and therefore the amount of replenishment toner required to maintain a desired toner concentration is small. Accordingly, the amount of toner that remains in the development device for a comparatively long time is large. The toner that remains in the development device for a comparatively long time is agitated for a long time, and therefore the toner in the development device is more likely to be excessively charged. Hence, the development ability is comparatively low. In contrast, when an image with a high image area ratio is output, the amount of new replenishment toner that is not sufficiently charged is large, and therefore the proportion of toner that is not charged to the desired charge within the toner that contributes to development is large. As a result, the development ability is comparatively high. In recent years, there has been a trend toward reducing the amount of developer in the development device as much as possible in response to demands for reductions in the size of the development device. As a result, the toner that contributes to development during image formation after outputting an image with a high image area ratio has a larger proportion of toner that is not charged to the desired charge. Hence, the development ability during image formation after outputting an image with a high image area tends to become comparatively high.

Depending on the structure, the development ability may become higher when an image with a low image area ratio is output than when an image with a high image area ratio is output. For example, when toner having an adhered additive is used and a development device in which the toner is subjected to a high level of stress is employed, the additive may become buried in or separate from the toner surface of the toner that has existed in the development device for a comparatively long time as a result of long-term agitation. When a large amount of such toner exists, the fluidity of the developer deteriorates and the charging ability of the toner decreases, and as a result, the toner that contributes to development cannot be charged to the desired charge. Hence, when an image having a low image area ratio is output, the proportion of toner that is not charged to the desired charge within the toner that contributes to development increases, and as a result, the development ability becomes comparatively high. In contrast, when an image with a high image area ratio is output, the replenishment toner amount is large, and therefore the amount of toner that has existed in the development device for a comparatively long time is small. Therefore, the fluidity of the developer is sufficiently favorable, and the amount of toner having a sufficient charging ability is large. Accordingly, the toner that contributes to development can be charged to the desired charge, and therefore the development ability is comparatively low.

As described above, the proportion of new toner in the development device following toner replenishment differs according to whether toner replenishment is performed after outputting an image having a low image area ratio or after outputting an image having a high image area ratio, and this difference leads to variation in the development ability. Hence, even when the development conditions are fixed and toner concentration control is performed to fix the toner concentration, the development ability cannot be fixed, and therefore a constant image density cannot be obtained.

An image forming apparatus described in Japanese Unexamined Patent Application Publication S57-136667 and Japanese Unexamined Patent Application Publication H2-34877 may be cited as an example of an apparatus capable of suppressing this problem. In this image forming apparatus, toner concentration detecting means are provided for detecting and outputting the toner concentration of a two-component developer in a development device. The output value of the toner concentration detecting means is compared to a toner concentration control reference value, and a toner replenishment device is controlled on the basis of the comparison result such that the toner concentration of the two-component developer in the development device reaches a desired toner concentration. Then, by detecting the density of a reference toner pattern formed in a non-image portion, the image density during formation of the reference toner pattern is learned, and on the basis of the detection result, the toner concentration control reference value is corrected. According to this method, image formation can be performed at a desired image density for a certain period of time following correction of the toner concentration control reference value. Hence, by forming the reference toner pattern and correcting the toner concentration control reference value in accordance with the detection result periodically, a constant image density can be obtained.

However, in the image forming apparatus described in these publications, the reference toner pattern must be formed every time the toner concentration control reference value is corrected, leading to an increase in the amount of toner consumed for a purpose other than image formation.

To solve this problem, an image forming apparatus described in Japanese Patent Application No. 2005-327647 comprises information detecting means for detecting information for learning a toner replacement amount in a development device over a predetermined time period, for example the image area ratio of an output image. From the detection result of the information detecting means, the ratio of new toner or old toner in the development device is learned, and thus the development ability of the development device is learned. Furthermore, a toner concentration control reference value is corrected by toner concentration control reference value correcting means on the basis of the detection result of the information detecting means, and by adjusting the toner concentration in the development device, a constant image density is obtained. In this image forming apparatus, the information regarding the toner replacement amount, which is used to correct the toner concentration control reference value, can be detected without consuming toner to detect the image area ratio of an output image or the like, and therefore increases in the amount of toner consumed for a purpose other than image formation can be suppressed.

However, this image forming apparatus is incapable of responding to variation in the development ability of the development device due to factors other than the toner replacement amount in the development device over a predetermined time period, for example environmental variation, the standing time, and so on. Therefore, the image density cannot be controlled appropriately by the inventions proposed in the related art.

Technologies relating to the present invention are also disclosed in, e.g., Japanese Unexamined Patent Application Publication 2005-331720.

SUMMARY OF THE INVENTION

The present invention has been designed in consideration of the background described above, and an object thereof is to provide an image forming apparatus and an image density control method which are capable of suppressing the amount of toner consumed for a purpose other than image formation and responding to variation in the development ability of a development device due to environmental variation and the like such that a constant image density is obtained.

In an aspect of the present invention, an image forming apparatus comprises an image carrier for carrying a latent image; a development device for developing the latent image on the image carrier into a toner image using a developer containing a toner and a magnetic carrier; a toner replenishment device for supplying replenishment toner to the development device; toner concentration detecting means for detecting a toner concentration of the two-component developer in the development device; toner concentration control means for controlling the toner concentration in the development device in accordance with a toner concentration control reference value that is referenced in order to control the toner concentration; a belt member provided in a position contacting the image carrier and stretched by a plurality of stretching members; toner pattern detecting means for detecting a toner pattern formed on the belt member; information detecting means for detecting information for learning a toner replacement amount in the development device over a predetermined time period; first toner concentration control reference value modifying means for modifying the toner concentration control reference value on the basis of a detection result of the information detecting means; and second toner concentration control reference value modifying means for modifying the toner concentration control reference value on the basis of a detection result of the toner pattern detecting means.

In another aspect of the present invention, an image density control method is provided for an image forming apparatus comprising an image carrier for carrying a latent image, a development device for developing the latent image on the image carrier into a toner image using a developer containing a toner and a magnetic carrier, a toner replenishment device for supplying replenishment toner to the development device, toner concentration detecting means for detecting a toner concentration of the two-component developer in the development device, toner concentration control means for controlling the toner concentration in the development device in accordance with a toner concentration control reference value that is referenced in order to control the toner concentration, a belt member provided in a position contacting the image carrier and stretched by a plurality of stretching members, and toner pattern detecting means for detecting a toner pattern formed on the belt member. An image density of an output image is controlled by modifying the toner concentration control reference value using at least first toner concentration control reference value modifying means for modifying the toner concentration control reference value on the basis of a detection result of information detecting means for detecting information for learning a toner replacement amount in the development device over a predetermined time period, and second toner concentration control reference value modifying means for modifying the toner concentration control reference value on the basis of a detection result of the toner pattern detecting means, as means for modifying the toner concentration control reference value.

BRIEF DESCRIPTION OF THE DRAWINGS

The above and other objects, features and advantages of the present invention will become more apparent from the following detailed description taken with the accompanying drawings in which:

FIG. 9 is a table showing an example of an LUT when the sensitivity of the permeability sensor is 0.3;

DESCRIPTION OF THE PREFERRED EMBODIMENT

Figure 1:
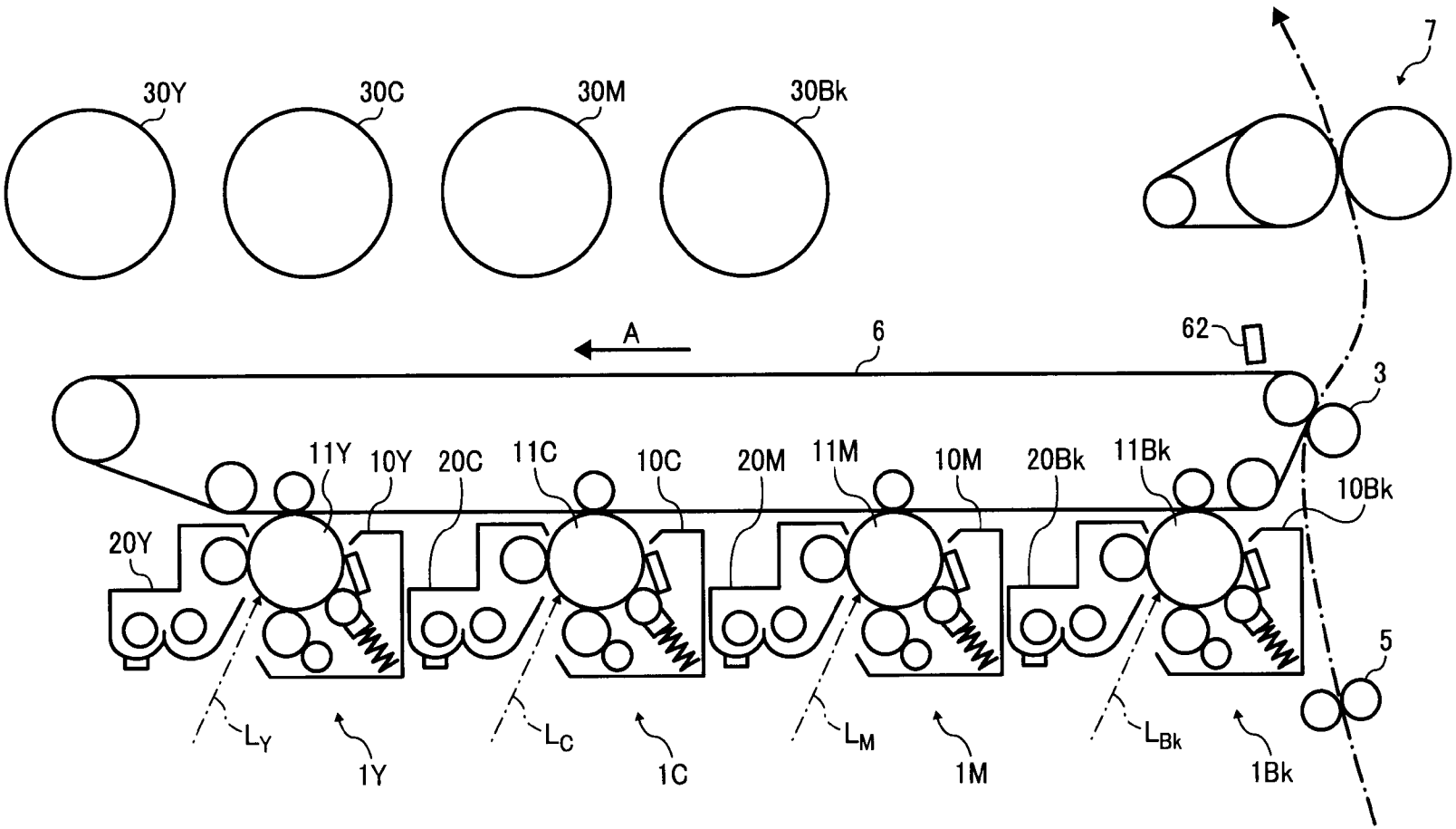
FIG. 1 is a view showing the schematic constitution of the main parts of a laser printer serving as an image forming apparatus according to an embodiment of the present invention.

First, an outline of the present invention will be described.

As described above, a constant image density cannot be obtained due to variation in the development ability resulting from differences in the amount of new replenishment toner or old toner in a development device. Hence, in the present invention, information for learning a toner replacement amount in the development device over a predetermined time period is detected. From this information, it is possible to learn the amount of toner in the development device that is consumed within the predetermined time period and the required amount of new replenishment toner. In other words, it is possible to learn the ratio of new toner or the ratio of old toner in the development device. Thus, the development ability can be learned, and therefore, on the basis of the information detection result, a toner concentration control reference value can be corrected by first toner concentration control reference value modifying means such that the development ability of the development device is maintained at a fixed level. Hence, even when image formation is performed such that the toner replacement amount in the development device changes, the development ability can be maintained at a fixed level by adjusting the toner concentration, and therefore a constant image density can be obtained. The information for learning the toner replacement amount in the development device can be detected without consuming toner, and therefore no toner need be consumed when the toner concentration control reference value is corrected by the first toner concentration control reference value modifying means.

Further, even when the development ability varies in accordance with environmental variation, the standing time, and so on, the image density can be learned by detecting a toner pattern formed on a belt member, and the toner concentration control reference value can be corrected by second toner concentration control reference value modifying means. Hence, even when the development ability varies due to factors other than the toner replacement amount in the development device, which cannot be dealt with by the first toner concentration control reference value modifying means, the toner concentration control reference value can be modified such that the development ability is maintained at a constant level, and the toner concentration can be adjusted. As a result, a constant image density can be obtained.

When the toner concentration control reference value is modified using a combination of the first toner concentration control reference value modifying means and second toner concentration control reference value modifying means, as in the present invention, the image density can be maintained at a substantially fixed level without consuming toner by the first toner concentration control reference value modifying means, and adjustment of the image density accompanying variation in the development ability due to environmental variation or the like can be dealt with by the second toner concentration control reference value modifying means. Note that variation in the development ability due to environmental variation, the standing time, and so on does not occur rapidly, and therefore variation in the development ability due to environmental variation and so on can be dealt with even when the toner concentration control reference value is modified infrequently by the second toner concentration control reference value modifying means. Hence, in the present invention, the frequency with which the toner pattern is detected to maintain the image density at a fixed level can be reduced in comparison with the related art, in which the image density is maintained at a fixed level on the basis of the toner pattern detection result alone, and as a result, toner consumption can be suppressed.

An embodiment in which the present invention is applied to an electrophotographic color laser printer (to be referred to as a "laser printer" hereafter) serving as an image forming apparatus will be described below.

FIG. 1 is a view showing the schematic constitution of the main parts of a laser printer according to this embodiment.

In this laser printer, four image creating means 1Y, 1C, 1M, 1Bk (hereafter, the suffixes Y, C, M, Bk are attached to reference symbols to indicate yellow, cyan, magenta, and black members, respectively) for forming images in each of magenta (M), cyan (C), yellow (Y), and black (Bk) are disposed in order from the upstream side of a surface motion direction (the direction of an arrow A in FIG. 1 of an intermediate transfer belt 6 serving as an intermediate transfer body. The image creating means 1Y, 1C, 1M, 1Bk respectively comprise photosensitive body units 10Y, 10C, 10M, 10Bk having drum-shaped photosensitive bodies 11Y, 11C, 11M, 11Bk serving as latent image carriers, and development devices 20Y, 20C, 20M, 20Bk. The image creation means 1Y, 1C, 1M, 1Bk are disposed such that the rotary axes of the photosensitive bodies 11Y, 11C, 11M, 11Bk in the respective photosensitive body units are parallel to each other at a predetermined pitch in the surface motion direction of the intermediate transfer belt 6.

Primary transfer is performed by superposing toner images formed on the photosensitive bodies 11Y, 11C, 11M, 11Bk by the image creating means 1Y, 1C, 1M, 1Bk onto the intermediate transfer belt 6 in sequence. An obtained superposed color image is conveyed to a secondary transfer portion between the intermediate transfer belt 6 and a secondary transfer roller 3 with the surface motion of the intermediate transfer belt 6. Further, in this laser printer, an optical writing unit, not shown in the drawing, is disposed beneath the image creating means 1Y, 1C, 1M, 1Bk, and a sheet feeding cassette, not shown in the drawing, is disposed beneath the optical writing unit. A dot-dash line in the drawing denotes the conveyance path of a transfer sheet. A transfer sheet fed from the sheet feeding cassette is conveyed by conveyance rollers while being guided by a conveyance guide, not shown in the drawing, and held in a temporary stop position in which a resist roller 5 is provided. At a predetermined timing, the transfer sheet is supplied to the secondary transfer portion by the resist roller 5. The color image formed on the intermediate transfer belt 6 is then subjected to secondary transfer onto the transfer sheet such that a color image is formed on the transfer sheet. The color toner image formed on the transfer sheet is then fixed by a fixing unit 7 and discharged onto a discharge tray 8.

Figure 2:
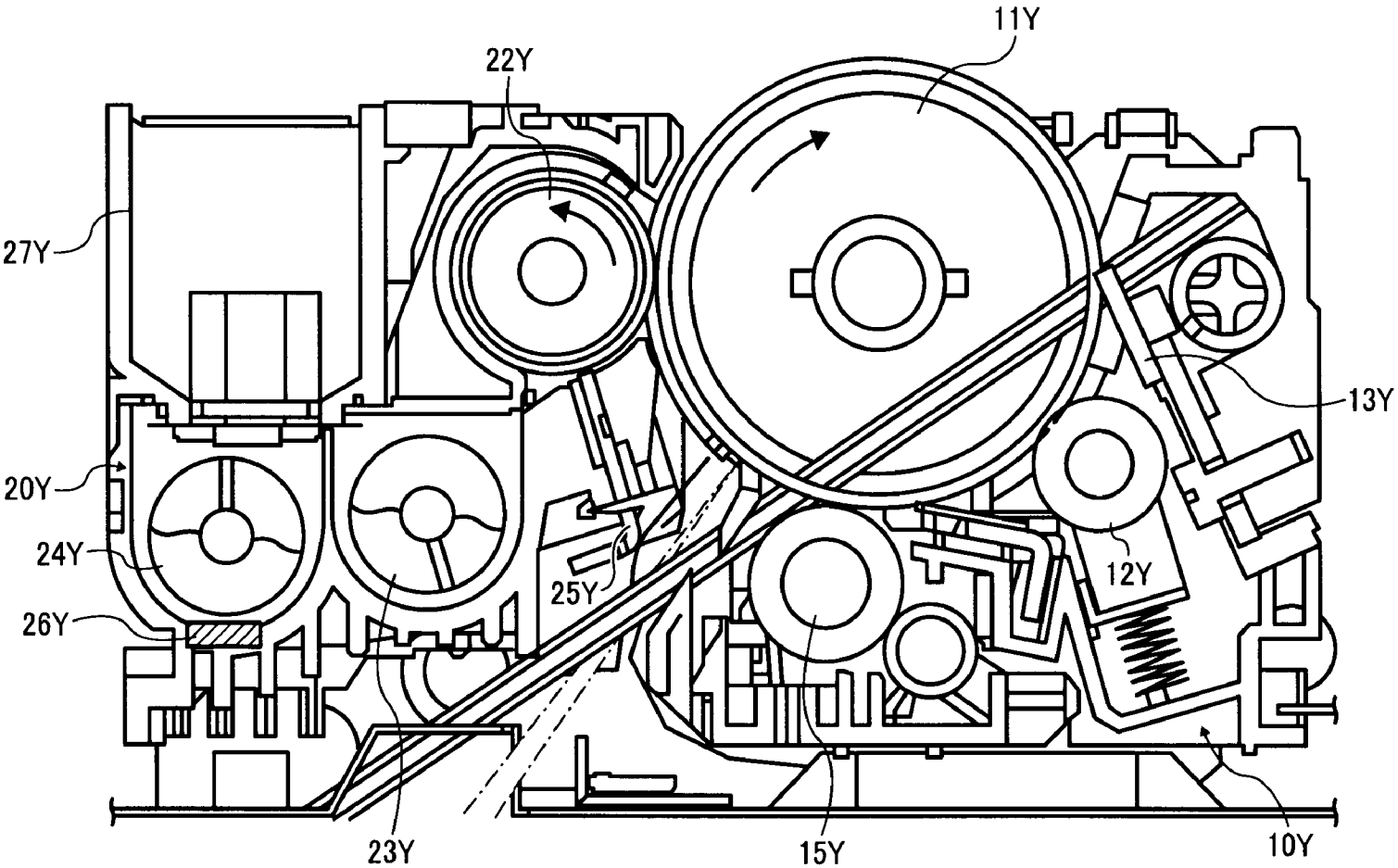
FIG. 2 is a view showing the schematic constitution of yellow image creating means from among image creating means provided in the laser printer.

FIG. 2 is an enlarged view showing the schematic constitution of the yellow image creating means 1Y from among the image creating means 1Y, 1C, 1M, 1Bk. The constitution of the other image creating means 1M, 1C, 1Bk is identical to that of the yellow image creating means 1Y, and therefore description thereof has been omitted.

In FIG. 2, the image creating means 1Y comprise the photosensitive body unit 10Y and the development device 20Y, as described above. The photosensitive body unit 10Y comprises, in addition to the photosensitive body 11Y, a cleaning blade 13Y for cleaning the photosensitive body surface, a charging roller 15Y for uniformly charging the photosensitive body surface, and soon. A lubricant applying and neutralizing brush roller 12Y having functions for coating the photosensitive body surface with lubricant and neutralizing the photosensitive body surface is also provided. A brush portion of the lubricant applying and neutralizing brush roller 12Y is constituted by conductive fibers, and a neutralizing power source, not shown in the drawing, for applying a neutralizing bias is connected to a core portion thereof.

In the photosensitive body unit 10Y having the constitution described above, the surface of the photosensitive body 11Y is uniformly charged by the charging roller 15Y, to which a voltage is applied. When the surface of the photosensitive body 11Y is irradiated with a scanned laser beam $L_Y$ that has been modulated and deflected by the optical writing unit, not shown in the drawing, an electrostatic latent image is formed on the surface of the photosensitive body 11Y. The electrostatic latent image on the photosensitive body 11Y is developed by the development device 20Y, to be described below, to form a yellow toner image. In a primary transfer portion where the photosensitive body 11Y faces the intermediate transfer belt 6, the toner image on the photosensitive body 11Y is transferred onto the intermediate transfer belt 6. Following transfer of the toner image, the surface of the photosensitive body 11Y is cleaned by the cleaning blade 13Y, which serves as photosensitive body cleaning means. The surface of the photosensitive body 11Y is then coated with a predetermined amount of lubricant and neutralized by the lubricant applying and neutralizing brush roller 12Y in preparation for formation of the next electrostatic latent image.

The development device 20Y uses a two-component developer (to be referred to hereafter simply as "developer") containing a magnetic carrier and a negatively charged toner as a developer for developing the electrostatic latent image. The development device 20Y also comprises a developing sleeve 22Y which is constituted by a non-magnetic material disposed so as to be partially exposed through an opening on the photosensitive body side of a development case and serves as a developer carrier, a magnet roller (not shown) which is disposed fixedly in the interior of the developing sleeve 22Y and serves as magnetic field generating means, agitating conveyance screws 23Y, 24Y serving as agitating conveyance members, a development doctor 25Y, a permeability sensor 26Y serving as toner concentration detecting means, a powder pump 27Y serving as a toner replenishment device, and so on. A developing bias voltage obtained by superimposing an AC voltage AC (AC component) on a negative DC voltage DC (DC component) is applied to the developing sleeve 22Y by a developing bias power source, not shown in the drawing, which serves as development electric field forming means, whereby the developing sleeve 22Y is biased to a predetermined voltage relative to a metallic base layer of the photosensitive body 11Y. Note that the negative DC voltage DC (DC component) alone may be applied as the developing bias voltage.

In FIG. 2, the toner is frictionally charged when the developer housed in a development case is agitated and conveyed by the agitating conveyance screws 23Y, 24Y. A part of the developer in a first agitating conveyance passage provided with the first agitating conveyance screw 23Y is carried on the surface of the developing sleeve 22Y, where the layer thickness thereof is restricted by the development doctor 25Y, and then conveyed to a development region opposing the photosensitive body 11Y. In the development region, the toner in the developer on the developing sleeve 22Y is adhered to the electrostatic latent image on the photosensitive body 11Y by a development electric field, thereby forming a toner image. Having passed through the development region, the developer is removed from the developing sleeve 22Y in a developer removal pole position on the developing sleeve 22Y, and returned to the first agitating conveyance passage. After being conveyed to a downstream end of the first agitating conveyance passage, the developer moves to an upstream end of a second agitating conveyance passage provided with the second agitating conveyance screw 24Y, and in the second agitating conveyance passage, toner replenishment is performed. After being conveyed to a downstream end of the second agitating conveyance passage, the developer moves to an upstream end of the first agitating conveyance passage. The permeability sensor 26Y is disposed in a part of the development case constituting a bottom portion of the second agitating conveyance passage.

The toner concentration of the developer in the development case decreases as toner is consumed during image formation, and therefore when necessary, the toner concentration is controlled within an appropriate range by supplying replenishment toner from a toner cartridge 30Y shown in FIG. 1 through the powder pump 27Y on the basis of an output value Vt of the permeability sensor 26Y. Toner replenishment control is performed on the basis of a difference Tn ($=Vt_{ref}-Vt$) between the output value Vt and a target output value $Vt_{ref}$ serving as a toner concentration control reference value such that when the difference Tn takes a positive (+) value, the toner concentration is determined to be sufficiently high and toner replenishment is not performed, and when the difference Tn takes a negative (−) value, the output value Vt is brought close to the value of the target output value $Vt_{ref}$ by supplying a steadily greater amount of replenishment toner as the absolute value of the difference Tn increases.

Further, the target output value $Vt_{ref}$, the charge potential, the light quantity, and so on are adjusted through process control every time the number of formed images reaches 10 to 50 images (depending on the copy speed and so on, between approximately 5 and 200 images). More specifically, for example, a plurality of half tone and solid patterns formed on the photosensitive body 11Y are transferred onto the intermediate transfer belt 6, the concentration thereof is detected by a reflection concentration sensor 62 shown in FIG. 1, the toner adhesion amount is learned from the resulting detection value, and the target output value $Vt_{ref}$, charge potential, light quantity and so on are adjusted such that the toner adhesion amount reaches a desired adhesion amount.

Also in this embodiment, processing for correcting the target output value $Vt_{ref}$ is performed separately to the process control every time an image is formed. The content of this processing will be described in detail below, together with the content of toner concentration control.

Of the four photosensitive bodies 11Y, 11C, 11M, 11Bk, only the black photosensitive body 11Bk on the furthest downstream side is in constant contact with the intermediate transfer belt 6 so as to form a constant transfer nip. The other photosensitive bodies 11M, 11C, 11Y are capable of contacting and separating from the intermediate transfer belt. When forming a color image on a transfer sheet, the four photosensitive bodies 11Y, 11C, 11M, 11Bk each come into contact with the intermediate transfer belt 6. When forming a monochrome black image on a transfer sheet, on the other hand, the color photosensitive bodies 11Y, 11C, 11M are removed from the intermediate transfer belt 6 such that only the black photosensitive body 11Bk for forming a toner image in black toner contacts the intermediate transfer belt 6.

Next, a control portion serving as control means for performing toner concentration control will be described.

Figure 3:
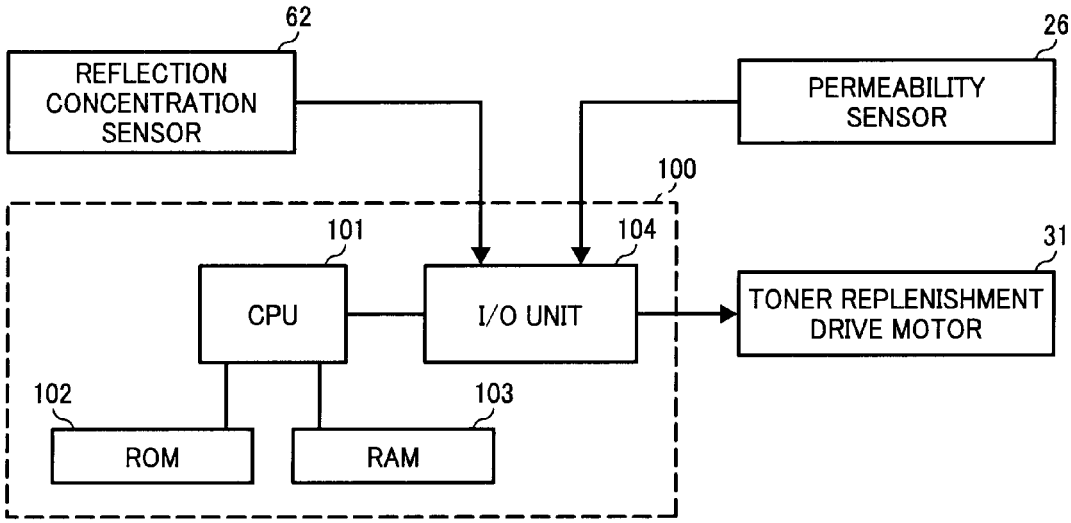
FIG. 3 is a block diagram showing the constitution of a control portion for performing toner concentration control on the laser printer.

FIG. 3 is an illustrative view showing the constitution of the control portion for performing toner concentration control.

A control portion 100 is provided in each development device, but all of the control portions 100 have a similar basic constitution, and therefore the color classification symbols (Y, C, M, Bk) will be omitted from the following description. Note that parts (a CPU 101, ROM 102, RAM 103, and so on) of the control portion 100 in each development device are shared among the development devices.

The control portion 100 of this embodiment is constituted by the CPU 101, the ROM 102, the RAM 103, an I/O unit 104, and so on. The aforementioned permeability sensor 26 and reflection concentration sensor 62 are connected to the I/O unit 104 via an A/D converter, not shown in the drawing. The control portion 100 controls the toner replenishment operation by having the CPU 101 execute a predetermined toner concentration control program such that a control signal is transmitted to a toner replenishment drive motor 31 for driving the powder pump 27 via the I/O unit 104. Further, by executing a predetermined target output value correction program, the target output value $Vt_{ref}$ is corrected every time an image is formed, and thus a constant image density is obtained at all times. The toner concentration control program and target output value correction program executed by the CPU and so on are stored in the ROM 102. A Vt register for temporarily storing the output value Vt of the permeability sensor 26, which is obtained via the I/O unit 104, a $Vt_{ref}$ register for storing the reference output value $Vt_{ref}$ to be output by the permeability sensor 26 when the toner concentration of the developer in the development device 20 matches the target toner concentration, a Vs register storing an output value Vs of the reflection concentration sensor 62, and so on are provided in the RAM 103.

Note that in this embodiment, the control portion 100 also functions as potential control means, first target output value correcting means, and second target output value correcting means, to be described below. However, to facilitate understanding of the present invention, the expressions "potential control means", "first target output value correcting means", and "second target output value correcting means" will be used as is.

Figure 4:
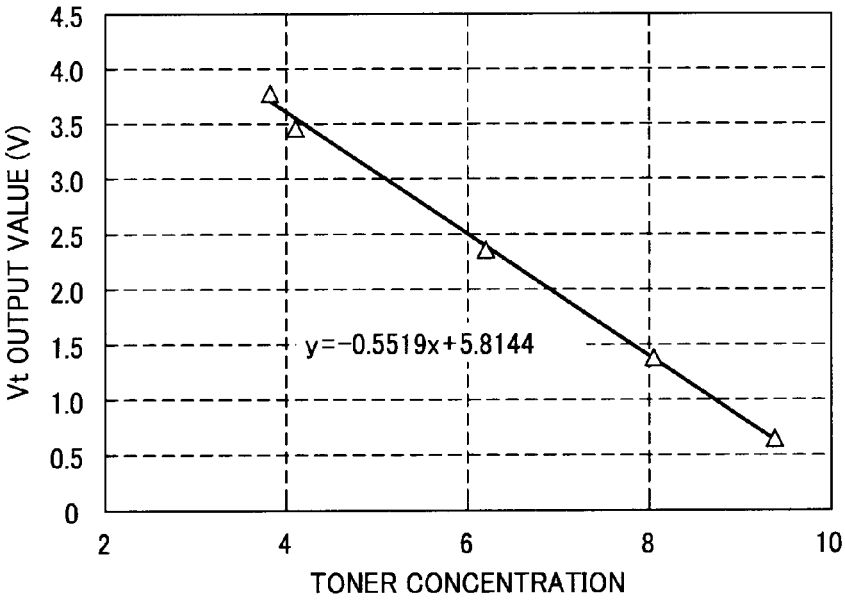
FIG. 4 is a graph having an output value of a permeability sensor on the ordinate and a toner concentration of a detection subject developer on the abscissa.

FIG. 4 is a graph having the output value of the permeability sensor 26 on the ordinate and the toner concentration of the detection subject developer on the abscissa.

As shown in the graph, in a practical toner concentration range, the relationship between the output value of the permeability sensor 26 and the toner concentration of the developer can be approximated by a straight line. The characteristic of this relationship is such that the output value of the permeability sensor 26 decreases as the toner concentration of the developer increases. Using this characteristic, toner replenishment is performed by driving the powder pump 27 when the output value Vt of the permeability sensor 26 is larger than the target output value $Vt_{ref}$. Conversely, when the output value Vt is smaller than the target output value $Vt_{ref}$, the powder pump 27 is stopped and toner replenishment is not performed. In this embodiment, toner replenishment control is performed on the basis of the output value Vt of the permeability sensor 26 every time an image is formed.

Figure 5:
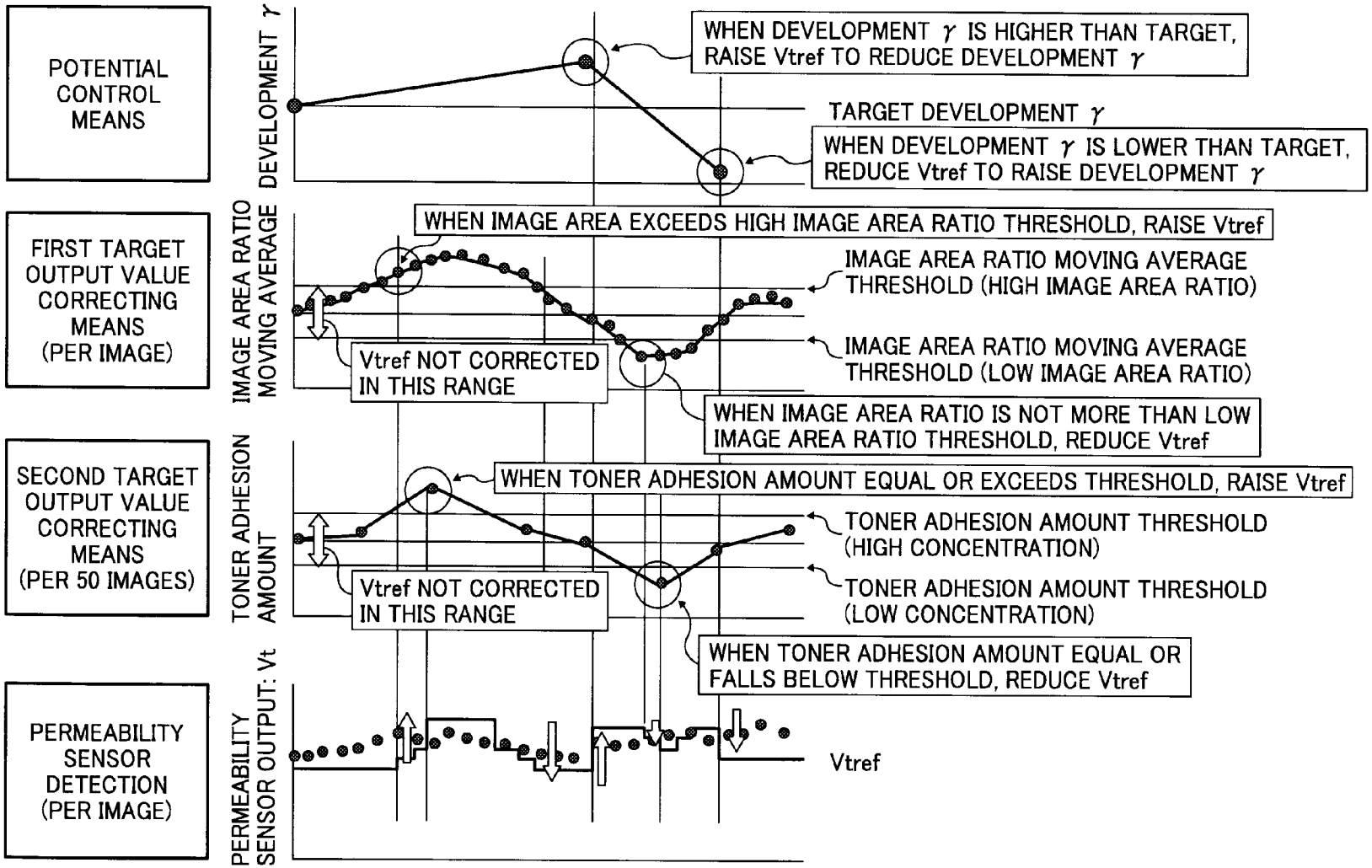
FIG. 5 is a view illustrating control relating to target output value correction processing.

Next, an outline of control relating to the target output value correction processing that is a feature of the present invention will be described using FIG. 5. As shown in FIG. 5, means for performing this control are constituted by the potential control means, the first target output value correcting means, and the second target output value correcting means. Note that in this embodiment, the control portion 100 also functions as the potential control means, first target output value correcting means, and second target output value correcting means, but to facilitate understanding of the present invention, the expressions "potential control means", "first target output value correcting means", and "second target output value correcting means" will be used as is. The potential control means measure a development γ (development ability) of the development device 20, determine the developing bias, and simultaneously vary the target output value $Vt_{ref}$. This control is executed every time 200 color images are output, for example.

The first target output value correcting means vary the target output value $Vt_{ref}$ in accordance with the toner replacement amount in the development device. The control performed by the first target output value correcting means is executed upon every job.

The second target output value correcting means form a toner pattern on the intermediate transfer belt 6 between sheets, or in other words between a rear end portion of a leading transfer sheet and a tip end portion of a following transfer sheet during continuous printing, and vary $Vt_{ref}$ by having the reflection concentration sensor 62 detect the toner pattern. This control is executed every 10 to 50 transfer sheets. Note that when a toner pattern is formed on the intermediate transfer belt 6 during continuous printing, the toner pattern is formed in a part of the intermediate transfer belt 6 corresponding to a space between the image on the leading transfer sheet and the image on the following transfer sheet, or in other words between the rear end portion of the leading transfer sheet and the tip end portion of the following transfer sheet, i.e. between sheets.

As described above, these control means perform control at their respective execution intervals to correct the target output value $Vt_{ref}$ and lead the toner concentration to its target. Note that the target output value $Vt_{ref}$ correction interval of the potential control means is longest, and the target output value $Vt_{ref}$ correction interval of the first target output value correcting means is shortest.

Next, the target output value correction processing performed by the potential control means will be described in detail.

First, in order to measure the development γ (development ability), the development potential is varied, and concentration-measuring toner patterns are created on the photosensitive body 11 in ten gradations. The toner patterns are created by fixing the potential of the laser beam emitted from the optical writing unit and varying the developing bias and charging bias. Further, a background portion potential, i.e. the difference between the charging bias and the developing bias, is fixed at 100 [V]. Note that the toner patterns are created in sequence from the low development potential side.

Next, the toner patterns on each photosensitive body, having been developed by the development device 20, are transferred onto the intermediate transfer belt 6. Note that in this embodiment, ten concentration-measuring toner patterns are created by the respective image creating means 1, but the development γ can be measured using fewer toner patterns. Preferably, at least three toner patterns having different densities are created. The concentration-measuring toner patterns of each color, which are transferred in parallel onto the intermediate transfer belt, are then subjected to toner concentration measurement simultaneously by the four reflection concentration sensors 62 disposed in parallel on the downstream side of the rotation direction of the intermediate transfer belt 6. The toner concentration is then converted into a toner adhesion amount [mg/cm$^2$], and a relational expression between the toner adhesion amount [mg/cm$^2$] and the development potential [kV] is obtained. The incline of this relational expression is the development γ indicating the development ability. From the relational expression, a developing bias value for obtaining a target toner adhesion amount can be calculated. In the control of the potential control means, a different development γ target value is set according to the environment, the rotation distance [m] of the developing sleeve 22, the rotation time [sec] of the photosensitive body, and so on. The development γ target value is compared with the current value of the development γ calculated previously, and when the current value of the development γ is larger than the target value, the target output value $Vt_{ref}$ is increased to make the toner concentration lower. When the current value of the development γ is smaller than the target value, $Vt_{ref}$ is set lower to make the toner concentration higher.

Next, the target output value correction processing performed by the first target output value correcting means will be described in detail.

Figure 6:
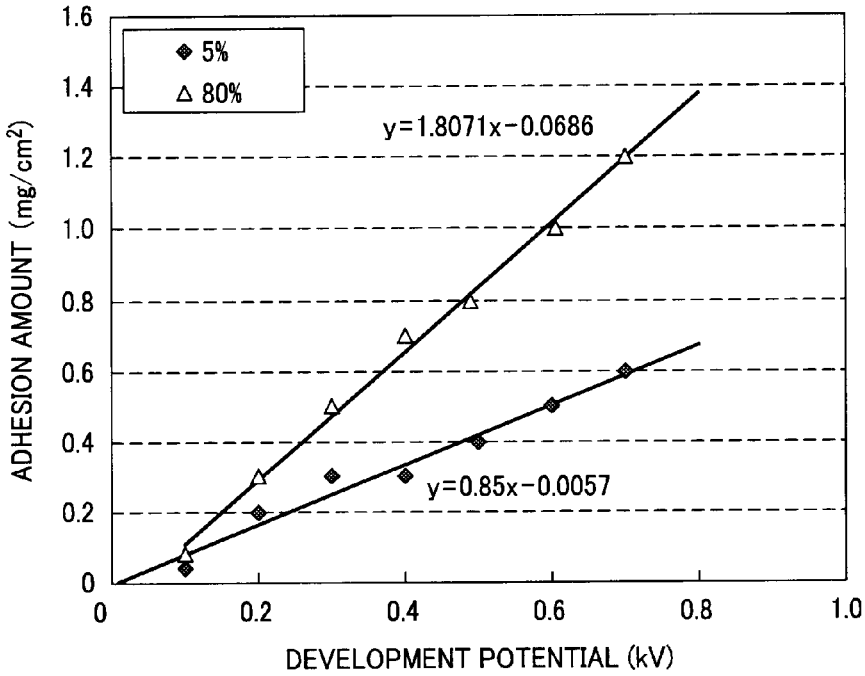
FIG. 6 is a graph showing variation in a development γ according an output image area ratio.

FIG. 6 is a graph showing variation in the development γ according to the output image area ratio (the incline of a relational expression between the development potential and the toner adhesion amount). This graph shows values obtained when 100 images having an identical image area ratio are output continuously in a standard linear velocity mode (138 [mm/sec]) As is evident from the graph, the development γ is higher when images having a high image area ratio are output. The presumed reason for this is as follows. When an image having a high image area ratio is output, the toner replacement amount in the development device 20 over a fixed time period is large, and therefore the amount of toner that remains in the development device 20 for a comparatively long time is small. Hence, the amount of excessively charged toner is small, and therefore, in comparison with a case in which images having a low image area ratio are output such that the amount of toner remaining in the development device 20 for a comparatively long time (the amount of excessively charged toner) is small, a high development ability can be exhibited.

Hence, according to differences in the toner replacement amount of the development device 20 over the fixed time period, differences occur in the development ability during subsequent image formation. When a difference occurs in the development ability, a difference also occurs in the image density of the formed image, and as a result, image formation cannot be performed at a constant image density. Hence, the target output value $Vt_{ref}$ is corrected such that the development ability is maintained at a fixed level, and in principle the development γ is fixed, even when the toner replacement amount of the development device 20 over the fixed time period varies. By correcting the target output value $Vt_{ref}$, the toner concentration is adjusted such that the output value Vt of the permeability sensor 26 nears the corrected target output value $Vt_{ref}$. As a result, the toner concentration is reduced, thereby reducing the development ability, when the toner replacement amount of the development device 20 is high, for example when images having a high image area ratio are output. Conversely, when the toner replacement amount of the development device 20 is low, for example when images having a low image area ratio are output, the toner concentration is increased, thereby increasing the development ability. Thus, the development ability is fixed.

The toner replacement amount of the development device 20 over the fixed time period may be learned from various information such as the surface area [cm$^2$] or image area ratio [%] of the output image. In this embodiment, a case in which the toner replacement amount is learned from the image area ratio will be described as an example. Note that the image area ratio [%] is converted into toner replacement amount [mg/page] units and used in the following manner. In this embodiment, when an appropriate development ability is exhibited and a 100% solid image is output on an A4 transfer sheet, 300 [mg] of toner is consumed and 300 [mg] of replenishment toner is supplied. Hence, in this case, the toner replacement amount is 300 [mg/page]. However, when A4 long edge feed is set as a reference transfer sheet, for example, and the image area ratio is converted into the toner replacement amount, the image area ratio must be converted by converting all of the output transfer sheets into the reference transfer sheet. The developer capacity of the development device 20 in this embodiment is 240 [g].

Figure 7:
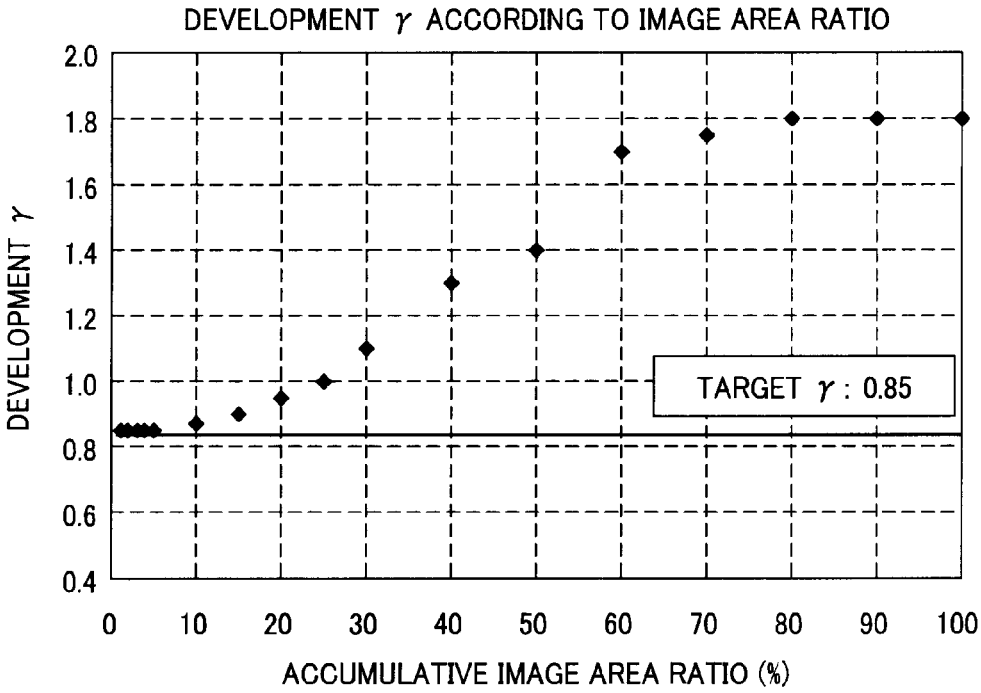
FIG. 7 is a graph having the image area ratio on the abscissa and the development γ on the ordinate.

FIG. 7 is a graph having the image area ratio [%] on the abscissa and the development γ [mg/cm$^2$/kV] on the ordinate.

Similarly to the graph shown in FIG. 6, this graph illustrates a case in which 100 images are printed continuously per image area ratio in a standard linear velocity mode while maintaining a fixed toner concentration. It can be seen from the graph that when the image area ratio exceeds a reference value of 5 [%], the development γ starts to increase. Hence, in the printer of this embodiment, when the image area ratio is higher than 5 [%], the target output value $Vt_{ref}$ is preferably increased to make the toner concentration lower and reduce the development γ so that the image density can be fixed. Conversely, when an image having an image area ratio of 5 [%] or less is output after the target output value $Vt_{ref}$ has been increased, the target output value $Vt_{ref}$ must be reduced to make the toner concentration higher.

Figure 8:
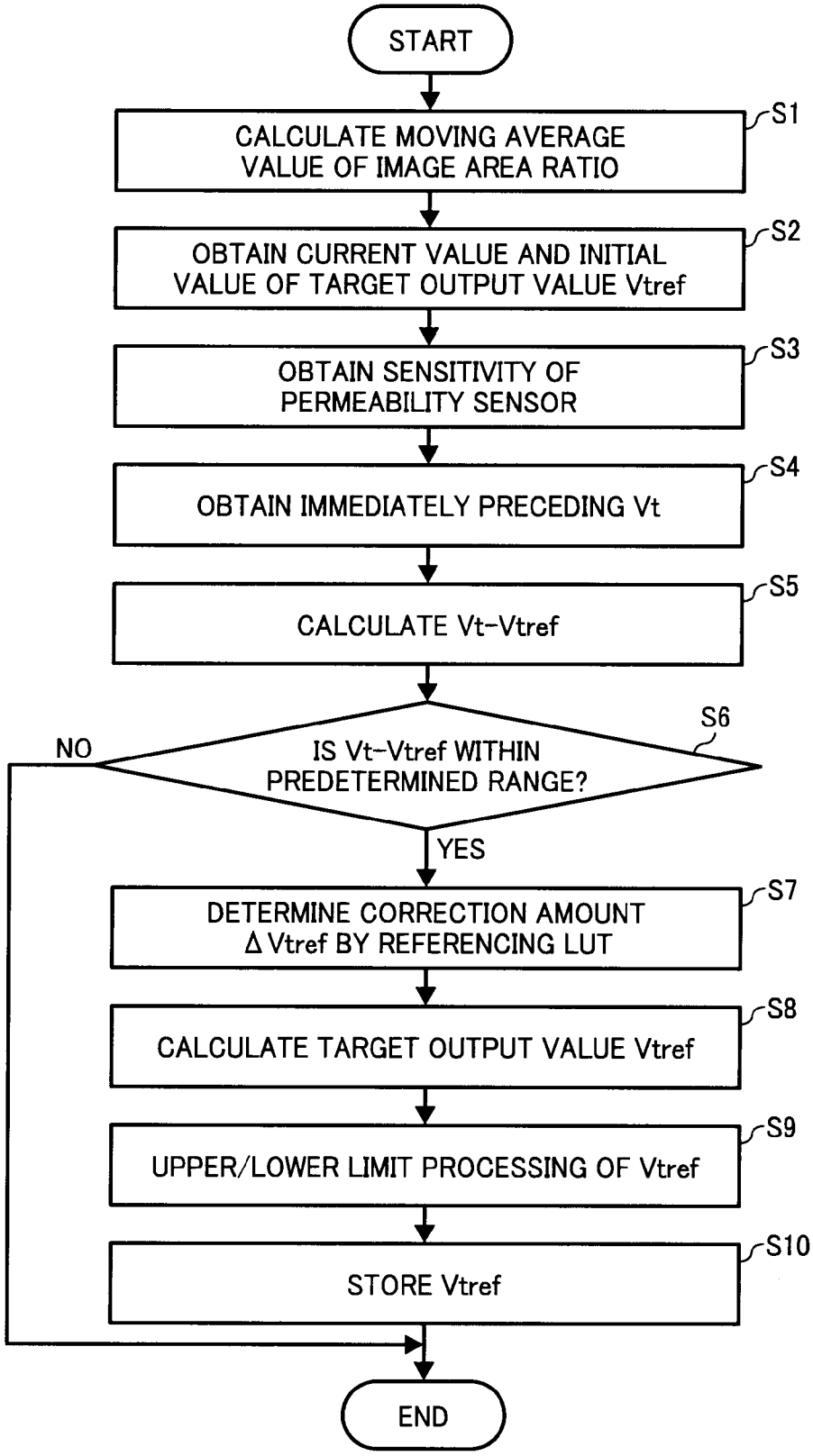
FIG. 8 is a flowchart showing the flow of target output value correction processing performed by first target output value correcting means'.

FIG. 8 is a flowchart showing the flow of the target output value correction processing performed by the first target output value correcting means.

This target output value correction processing is executed every time a print job ends. When a print job ends, the control portion 100 first calculates a moving average value of the image area ratio [%] of images output within a fixed time period corresponding to several past images or several tens of past images printed immediately before the present time (S1). A simple average value of the image area ratio [%] may be used instead of a moving average value, but when a moving average value is used, the history of the toner replacement amount of past images, which is useful for learning the developer characteristics at the current time, can be learned. Hence, in this embodiment a moving average value is used. For simplicity, the moving average value is calculated according to the following Equation (1).

$$M(i)=(1/N)\{M(i-1)\times(N-1)+X(i)\} \quad \text{Eq. (1)}$$

Here, "N" is the sampled number (accumulative number) of image area ratios, "M (i−1)" is a previously calculated moving average value, and "X (i)" is the current image area ratio. Note that M (i) and X (i) are calculated individually for each color.

In this embodiment, the current moving average value is determined using the previously calculated moving average value, and therefore the need to store image area ratio data relating to several or several tens of past images in the RAM 103 is eliminated. Hence, the used area of the RAM 103 can be reduced greatly. Furthermore, the control response can be modified by modifying the accumulative number N appropriately. By modifying the accumulative number N in accordance with environmental variation or the elapsed time, for example, control can be performed more effectively.

After calculating the moving average value in the manner described above, the control portion 100 obtains the current value of the target output value $Vt_{ref}$ and an initial value of the target output value $Vt_{ref}$ from the $Vt_{ref}$ register (S2). The initial value and current value of $Vt_{ref}$ are defined as shown in Equation (2).

$$(\text{Current value of } Vt_{ref}) = (\text{initial value of } Vt_{ref}) + \Delta Vt_{ref} \quad \text{Eq. (2)}$$

Further, the control portion 100 obtains sensitivity information relating to the permeability sensor 26 (S3). The sensitivity of the permeability sensor 26 is expressed in units of [V/wt %] and is unique to the sensor (the absolute value of the incline of the plotted straight line in FIG. 4 is the sensitivity). Next, the control portion 100 obtains the immediately preceding output value Vt of the permeability sensor 26 (S4), and uses the current value of the target output value $Vt_{ref}$ obtained in S2 to calculate $Vt-Vt_{ref}$ (S5). Next, the control portion 100 determines whether or not to correct the target output value $Vt_{ref}$. For example, a determination as to whether or not the previous process control was successful or a determination as to whether or not the result of $Vt-Vt_{ref}$ calculated in S5 is within a predetermined range is used as a determination reference. In this embodiment, a determination is made as to whether or not the result of $Vt-Vt_{ref}$ calculated in S5 is within a predetermined range (S6).

When the result of $Vt-Vt_{ref}$ is within the predetermined range, an LUT is referenced to determine a correction amount $\Delta Vt_{ref}$ (S7). More specifically, first the LUT is referenced to determine a toner concentration correction amount ΔTC (an amount by which to vary the toner concentration) corresponding to the moving average value calculated in S1. After determining the toner concentration correction amount ΔTC, the sensitivity of the permeability sensor 26 obtained in S3 is used to calculate the target output value correction amount $\Delta Vt_{ref}$ from the following Equation (3). The calculated correction amount $\Delta Vt_{ref}$ is stored in the RAM 103. Note that the correction amount $\Delta Vt_{ref}$ is calculated individually for each color.

$$\Delta Vt_{ref} = (-1) \times \Delta TC \times (\text{sensitivity of permeability sensor } 26) \quad \text{Eq. (3)}$$

FIG. 9 shows an example of an LUT when the sensitivity of the permeability sensor 26 is 0.3.

The LUT used in this embodiment is created using the following method.

Figure 10:
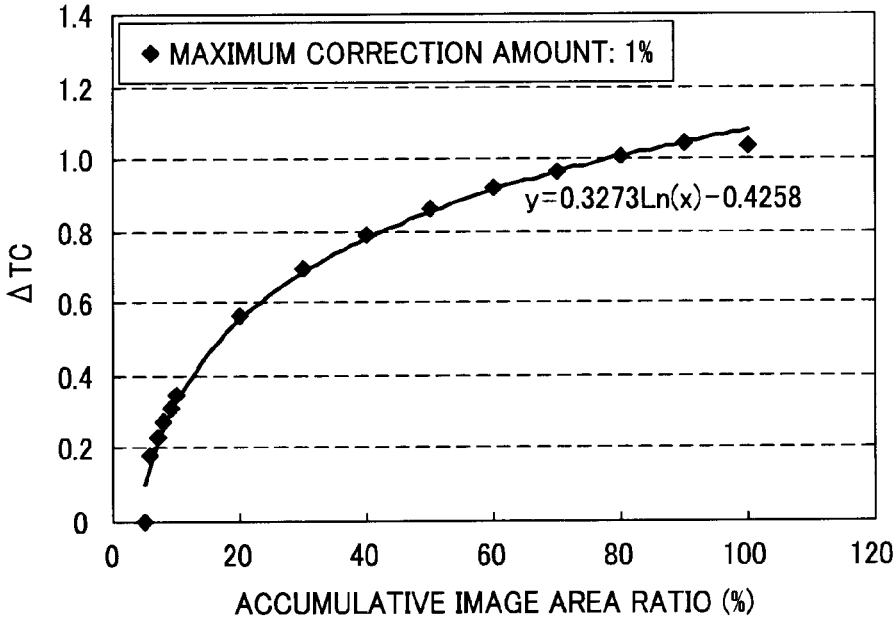
FIG. 10 is a graph having a moving average value of the image area ratio on the abscissa and a toner concentration modification amount for fixing the development γ relative to a reference toner concentration on the ordinate.

FIG. 10 is a graph having the moving average value [%] of the image area ratio on the abscissa and a minus direction toner concentration correction amount [wt %] for varying the toner concentration in order to fix the development γ relative to a reference toner concentration on the ordinate.

It can be seen from this graph that when the moving average value of the image area ratio is 80%, for example, and toner concentration control is performed with a toner concentration correction amount ΔTC of −1 [wt %], the development γ is held at a fixed level. The toner concentration correction amount ΔTC relative to the moving average value of the image area ratio can be approximated most accurately by logarithmic approximation. Hence, the toner concentration correction amount ΔTC relative to the moving average value used in the LUT is determined using a logarithmic approximation method. In this embodiment, as shown in FIG. 9, when the moving average value is less than 10%, a correction step is set at 1%, and when the moving average value is equal to or greater than 10%, the correction step is set at 10%. The correction step may be modified arbitrarily in accordance with the characteristics of the developer and development device.

Further, the use condition of the developer varies according to its color, and therefore various conditions such as the correction step and the execution timing of the target output value correction processing may be varied for each development device 20. It is particular preferable to adjust the maximum correction amount for each color. In this case, the following Equation (4), for example, is used in place of Equation (3).

$$\Delta Vt_{ref} = (-1) \times \Delta TC \times (\text{sensitivity of permeability sensor } 26) \times (\text{color correction coefficient}) \quad \text{Eq. (4)}$$

After determining the correction amount $\Delta Vt_{ref}$ by referencing the LUT in the manner described above (S7), the control portion 100 calculates the corrected target output value $Vt_{ref}$ for each color from the determined correction amount $\Delta Vt_{ref}$ and the initial value of $Vt_{ref}$ obtained in S2 using the following Equation (5) (SB).

$$(\text{Corrected } Vt_{ref}) = (\text{initial value of } Vt_{ref}) + \Delta Vt_{ref} \quad \text{Eq. (5)}$$

Next, the control portion 100 performs upper/lower limit processing on the calculated $Vt_{ref}$ (S9). More specifically, when the calculated $Vt_{ref}$ exceeds a preset upper limit value, the upper limit value is set as the corrected $Vt_{ref}$. On the other hand, when the calculated $Vt_{ref}$ is lower than a preset lower limit value, the lower limit value is set as the corrected $Vt_{ref}$. When the calculated $Vt_{ref}$ is between the upper limit value and lower limit value, the calculated $Vt_{ref}$ is set as the corrected $Vt_{ref}$. The corrected $Vt_{ref}$ obtained in this manner is stored in the RAM 103 as the current value of $Vt_{ref}$ (S10).

The target output value correction processing is preferably executed during continuous printing from the end of a preceding development operation to the start of a current development operation. By performing the processing at this timing, toner concentration control can be performed using a target output value $Vt_{ref}$ that is appropriately corrected for each output image even during continuous printing.

In this embodiment, the stability of the image density of an output image is improved greatly by employing the first target output value correcting means. However, several improvements are required in control using the first target output value correcting means.

Firstly, the correction amount must be slightly reduced to avoid excessive correction, and therefore it is sometimes impossible to correct the image density completely. Secondly, it is sometimes impossible to correct the image density completely due to rapid environmental variation, rapid variation in the image output mode, and so on. Thirdly, the image density may vary due to environmental variation, the standing time, and so on even when the image area ratio (toner replacement amount) remains unchanged. These problems are due to the fact that the first target output value correcting means do not possess a feedback function.

Next, target output value correction processing using the second target output value correcting means will be described in detail. In this embodiment, feedback relating to the target output value $Vt_{ref}$ is obtained by creating a reference toner pattern on the part of the intermediate transfer belt 6 corresponding to the space between sheets and detecting the toner concentration of the reference toner pattern using the reflection concentration sensor 62, as described above.

Figure 11:
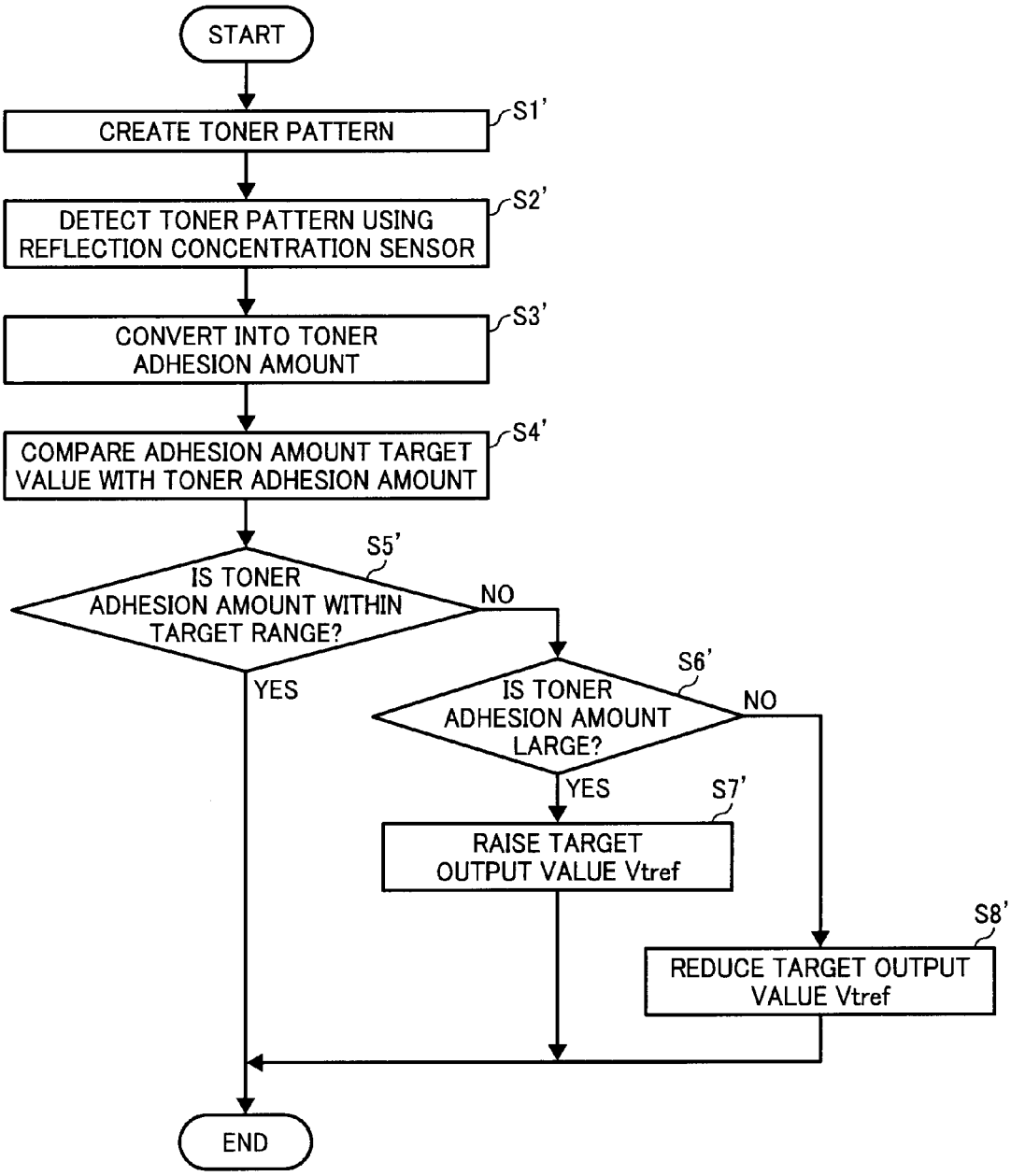
FIG. 11 is a flowchart showing the flow of target output value correction processing performed by second target output value correcting means.

The target output value correction processing performed by the second target output value correcting means will now be described specifically using the flowchart shown in FIG. 11.

First, the reference toner pattern is created on the part of the intermediate transfer belt 6 corresponding to the space between sheets (S1'). Note that the size of the created reference toner pattern is 12 mm in a main scanning direction and 15 mm in a sub-scanning direction. Furthermore, in this embodiment, a solid write pattern is used as the reference toner pattern, but any pattern that is comparatively stable, such as a 2×2 pattern or the like, can be detected accurately. As regards the developing bias, a fixed value may be used, or an image portion bias calculated during the previous potential control process control may be used. Further, to reduce the amount of toner used in the detection, a lower developing bias may be used in the measurement. Next, the toner concentration of the reference toner pattern is measured by the reflection concentration sensor 62 (S2'). Note that the reflection concentration sensor 62 is constituted by a light emitting portion and a light receiving portion, in which LED light is emitted from the light emitting portion onto the reference toner pattern created on the intermediate transfer belt 6 and reflection light therefrom is detected by a phototransistor of the light receiving portion. In relation to the black reference toner pattern, regular reflection light is used as the reflection light, and in relation to the magenta, cyan, and yellow color patterns, diffuse reflection light is used as the reflection light.

Next, the toner concentration of the reference toner pattern of each color is converted into a toner adhesion amount (S3'). In this conversion process, for example, a conversion table of the toner adhesion amount relative to the detected intensity of the reflection light is created in advance, and the toner concentration is converted into a toner adhesion amount in accordance with the table. Next, a toner adhesion amount target value is compared to the calculated toner adhesion amount (S4'). Note that in this embodiment, the adhesion amount target value is 0.4±0.4 [mg/cm$^2$] in relation to the magenta, cyan, and yellow reference toner patterns, and 0.3±0.3 [mg/cm$^2$] in relation to the black reference toner pattern. Since regular reflection is used for the black pattern, detection cannot be performed up to a high toner adhesion amount region, and therefore detection is performed in a low toner adhesion amount region.

Next, a determination is made as to whether or not the toner adhesion amount of the reference toner pattern is within the target range (S5'). When the toner adhesion amount is within the target range, target output value correction processing by the second target output value correcting means is terminated without modifying the target output value $Vt_{ref}$(Y in S5'). When the toner adhesion amount is not in the target range, a determination is made as to whether or not the toner adhesion amount is greater than the target range (S6'). When it is determined that the toner adhesion amount is greater than the target range (Yes in S6'), the target output value $Vt_{ref}$ is raised (S7'), thereby leading the toner concentration in a decreasing direction, whereupon the correction processing is terminated. When it is determined that the toner adhesion amount is smaller than the target range (No in S6'), $Vt_{ref}$ is reduced (S8'), thereby leading the toner concentration in an increasing direction, whereupon the control is terminated.

When target output value correction processing is performed using the second target output value correcting means, accuracy improves steadily as the frequency with which the reference toner pattern is created increases. However, when the reference toner pattern creation frequency is raised, the amount of wasted toner increases. Therefore, also from an environmental viewpoint, it is difficult to increase the reference toner pattern creation frequency. Conversely, if the reference toner pattern creation frequency is simply reduced, the toner concentration of the reference toner pattern may have already varied greatly when the reference toner pattern is created during the control performed by the second target output value correcting means. As a result, the image density of an image that is output within the reference toner pattern creation interval cannot be controlled accurately.

Hence, when correction processing is performed on the target output value $Vt_{ref}$ in this embodiment, the first target output value correcting means and second target output value correcting means are used in a combination that utilizes the advantages of each, rather than being used independently.

For example, in the first target output value correcting means, parameters tend to vary from the starting point of an operation. Accordingly, errors may occur due to parameter measurement, machine tolerance, and so on. Hence, with the first target output value correcting means alone, these errors may become control errors. Furthermore, when disturbances such as environmental variation and standing time occur, no function exists to respond to these disturbances. Hence, when the target output value $Vt_{ref}$ is controlled using the first target output value correcting means alone, the amount of movement in the variable parameters must be reduced in order to suppress excessive correction. In this sense, it is difficult to control the image density of an output image completely with this control alone.

Further, in the control performed by the second target output value correcting means, which correct the target output value $Vt_{ref}$ by creating reference toner patterns, the target output value $Vt_{ref}$ is not controlled until a deviation occurs in the toner concentration, but if a deviation occurs in the toner concentration of the reference toner pattern for some reason, the target output value $Vt_{ref}$ can be controlled in a direction for eliminating the deviation.

Hence, by combining the first target output value correcting means and second target output value correcting means, as in this embodiment, feedback can be provided in relation to each, and as a result, the first target output value correcting means can set the correction amount of the target output value $Vt_{ref}$ to be large, which is highly advantageous. Further, the frequency with which the second target output value correcting means create the reference toner patterns can be reduced, and therefore the amount of wasted toner can be reduced greatly, which is highly advantageous in terms of sales.

Note that when correction control is performed on the target output value $Vt_{ref}$ by the first target output value correcting means and second target output value correcting means, basic control under normal conditions is preferably performed by the first target output value correcting means, and the second target output value correcting means are preferably used to check whether or not correction of the target output value $Vt_{ref}$ by the first target output value correcting means has been executed correctly. By performing control in this manner, the amount of toner that is wasted when creating the reference toner patterns can be suppressed even further, and the image density can be maintained at a fixed level even more accurately.

For example, when correction control is performed on the target output value $Vt_{ref}$ using the second target output value correcting means alone, as in the related art, a sufficient effect in terms of maintaining the image density at a fixed level can only be obtained by performing the control at intervals of five transfer sheets, and preferably at intervals of two transfer sheets. However, by adopting a control pattern in which basic control is performed by the first target output value correcting means, the execution interval of the correction control performed by the second target output value correcting means can be lengthened to between 10 and 50 sheets.

Further, when disturbances such as environmental variation and standing time occur, these disturbances can be dealt with by increasing the frequency with which the toner pattern is created by the second target output value correcting means to increase the amount of feedback supplied to the apparatus main body. For example, in this embodiment, when the accumulative average [%] of the image area ratio is smaller than 2 [%] or no less than 60 [%] in the LUT of FIG. 9*, control is introduced to shorten the reference toner pattern creation interval. The reason for this is that the image density may shift to an unexpectedly high level due to a high image area ratio, environmental variation, deterioration over time, and so on. Further, when the image area ratio is extremely low, the image density may shift to an unexpectedly low level, and in this case, the reference toner pattern creation frequency is increased so that correction control of the target output value $Vt_{ref}$ using the second target output value correcting means is performed more often.

Conversely, during image output of approximately 5%, the reference toner pattern creation interval is lengthened such that the image density can be maintained at a sufficiently fixed level even when the frequency with which the target output value $Vt_{ref}$ is subjected to correction control by the second target output value correcting means decreases.

When the target output value $Vt_{ref}$ is subjected to correction control using the first target output value correcting means and second target output value correcting means in conjunction rather than independently, a highly synergistic effect is obtained. Note that when the correction of the first target output value correcting means and the correction of the second target output value correcting means are performed simultaneously, correction control of the target output value $Vt_{ref}$ by the second target output value correcting means is preferably given precedence. The reason for this is that the second target output value correcting means are capable of correcting the target output value $Vt_{ref}$ when a deviation occurs in the toner concentration of the reference toner pattern, regardless of the cause thereof, as described above, and therefore more stable image output is possible.

Next, comparative experimental examples comparing cases in which the target output value correction processing described above is performed and cases in which the processing is not performed will be described.

Figure 12:
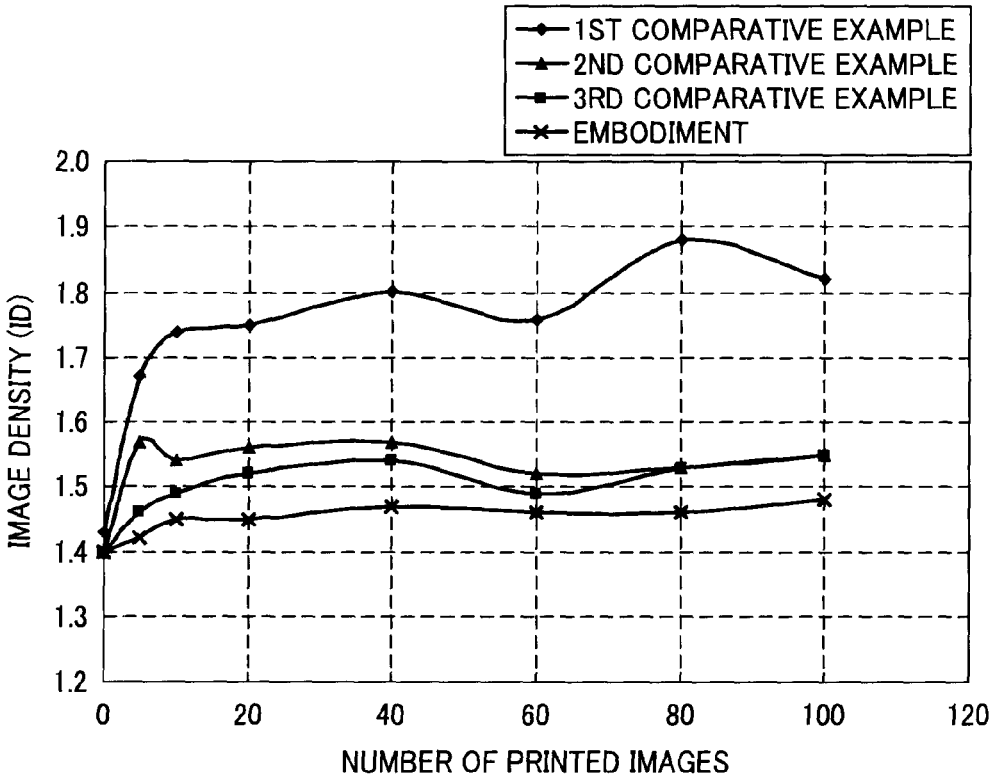
FIG. 12 is a graph showing the results of comparative experimental examples.

FIG. 12 is a graph showing the results of these comparative experimental examples.

In these comparative experimental examples, the laser printer of the embodiment described above was used. In a standard linear velocity mode (138 mm/s), 100 solid images having an image area ratio of 70% were formed continuously, and the image density thereof was measured. In a first comparative example plotted using rhomboids, correction of the target output value $Vt_{ref}$ by the first and second target output value correcting means was not performed, and therefore the image density ID increases as the printing job proceeds. In a second comparative example plotted using triangles, the target output value $Vt_{ref}$ was corrected by the second target output value correcting means alone at intervals of several images. In this case, correction is introduced following a single large increase in the image density ID, and therefore a part in which the image density ID is temporarily high exists. In a third comparative example plotted using squares, the target output value $Vt_{ref}$ is corrected by the first target output value correcting means alone. In this case, correction of the target output value $Vt_{ref}$ is introduced from the beginning, and therefore the image density ID is suppressed to a lower level. However, a slight increase in the image density ID occurs.

Meanwhile, in this embodiment, which is plotted using crosses, the target output value $Vt_{ref}$ is corrected using the first target output value correcting means and the second target output value correcting means, and therefore the image density ID is maintained within a substantially fixed range even as the number of continuously printed images increases. The reason for this is that correction of the target output value $Vt_{ref}$ is executed at different correction intervals utilizing the respective advantages of the first target output value correcting means, which perform detailed correction on every image, and the second target output value correcting means, which perform correction at intervals of several to several tens of images in consideration of the effect of external disturbances.

Hence, it can be confirmed from these comparative experimental examples that by adopting target output value correction processing control such as the control of this embodiment, image density stability when outputting images resulting in a high toner replacement amount, or in other words images having a high image area ratio, can be improved greatly.

According to the embodiment described above, in a laser printer serving as an image forming apparatus comprising the photosensitive body 11, which serves as an image carrier for carrying a latent image, the development device 20 for developing the latent image on the photosensitive body 11 into a toner image using a developer containing a toner and a magnetic carrier, the powder pump 27, which serves as a toner replenishment device for supplying replenishment toner to the development device 20, the permeability sensor 26, which serves as toner concentration detecting means for detecting the toner concentration of the two-component developer in the development device 20, the control portion 100, which serves as toner concentration control means for controlling the toner concentration in the development device 20 in accordance with the target output value $Vt_{ref}$ serving as a toner concentration control reference value that is referenced in order to control the toner concentration, the intermediate transfer belt 6, which serves as a belt member provided in a position contacting the photosensitive body 11 and stretched by a plurality of stretching members, and the reflection concentration sensor 62, which serves as toner pattern detecting means for detecting a toner pattern formed on the intermediate transfer belt 6, the control portion 100 also functions as information detecting means for detecting an image area ratio, which is used as information for learning a toner replacement amount in the development device 20 over a predetermined time period, and at least the first target output value correcting means serving as first toner concentration control reference value modifying means for modifying the target output value $Vt_{ref}$ on the basis of a detection result of the control portion 100, and the second target output value correcting means serving as second toner concentration control reference value modifying means for modifying the target output value $Vt_{ref}$ on the basis of a detection result of the reflection concentration sensor 62, are provided as means for modifying the target output value $Vt_{ref}$. Thus, the target output value $Vt_{ref}$ can be corrected by the first target output value correcting means on the basis of the detection result of the image area ratio detected by the control portion 100 such that the development ability of the development device 20 is maintained at a fixed level. As a result, even when image formation is performed such that the toner replacement amount in the development device 20 varies, the development ability can be maintained at a fixed level by adjusting the toner concentration, and therefore a constant image density can be obtained. Furthermore, the information for learning the toner replacement amount in the development device 20 can be detected without consuming toner, and therefore no toner need be consumed when the target output value $Vt_{ref}$ is corrected by the first target output value correcting means.

In this embodiment in particular, the aforementioned information detecting means are constituted by the control portion 100, which functions as image area ratio detecting means for detecting the image area ratio of the images formed within the predetermined time period, and therefore the information for learning the toner replacement amount can be detected without consuming toner by means of a comparatively simple constitution.

Further, when the development ability varies due to environmental variation, the standing time, and so on, the target output value $Vt_{ref}$ can be corrected by the second target output value correcting means by learning the toner concentration from the detection result produced by the reflection concentration sensor 62 for detecting the toner pattern formed on the intermediate transfer belt 6. Thus, even when the development ability varies due to factors other than the toner replacement amount of the development device 20 that cannot be dealt with by the first target output value correcting means, the toner concentration can be adjusted such that the development ability is maintained at a fixed level, and therefore a constant image density can be obtained.

Also according to this embodiment, the interval at which the target output value $Vt_{ref}$ is modified differs between the first target output value correcting means and second target output value correcting means. For example, when the target output value $Vt_{ref}$ is corrected meticulously by the first target output value correcting means after every image and corrected by the second target output value correcting means at an interval of several to several tens of images, the image density ID is held within a substantially fixed range even when the number of continuously printed images increases as in the comparative experimental examples described above.

Also according to this embodiment, the first toner concentration control reference value modifying means modify the target output value $Vt_{ref}$ on the basis of a moving average value of the image area ratio of the images formed within the predetermined time period, which is obtained from the detection result of the control portion 100. Thus, the toner replacement amount history over several past images, which is useful for learning the developer characteristics at the current time, can be learned. As a result, the target output value $Vt_{ref}$ can be corrected more appropriately. The moving average value M (i) is calculated on the basis of the equation shown above in Numeral 1, and therefore the used area of the RAM 103 can be reduced greatly, as described above. Note that the control portion 100 may correct the target output value $Vt_{ref}$ on the basis of an average value of the image area ratio of the images formed within the predetermined time period, which is obtained from the image area ratio detection result, rather than a moving average value. In this case also, the image area ratio of the images formed within the predetermined time period can be learned appropriately by means of a simple method.

Also according to this embodiment, the first toner concentration control reference value modifying means modify the target output value $Vt_{ref}$ on the basis of the detection result of the control portion 100 so as to reduce the toner concentration when the toner replacement amount in the development device 20 over the predetermined time period is greater than a reference amount and so as to increase the toner concentration when the toner replacement amount in the development device 20 over the predetermined time period is smaller than the reference amount. Thus, when the development ability rises such that the development γ rises, as in this embodiment, the target output value $Vt_{ref}$ can be corrected easily and appropriately when an image having a high image area ratio is output, for example.

Also according to this embodiment, the interval at which the second target output value correcting means modify the target output value $Vt_{ref}$ is varied in accordance with the toner replacement amount, or in other words the image area ratio. For example, control is introduced to shorten the reference toner pattern creation interval when an accumulative average [%] of the image area ratio is no less than a first threshold of 60 [%] and less than a second threshold of 2 [%]. The reason for this is that the image density may shift to an unexpectedly high level due to a high image area ratio, environmental variation, deterioration over time, and so on. Further, when the image area ratio is extremely low, the image density may shift to an unexpectedly low level, and in this case, the reference toner pattern creation frequency is increased so that correction control of the target output value $Vt_{ref}$ using the second target output value correcting means is performed more often. Conversely, during image output of approximately 5%, the reference toner pattern creation interval is lengthened such that the image density can be maintained at a sufficiently fixed level even when the frequency with which the target output value $Vt_{ref}$ is subjected to correction control by the second target output value correcting means decreases.

Also according to this embodiment, the first target output value correcting means modify the target output value $Vt_{ref}$ from the end of a previous image creation operation to the beginning of a following image creation operation. As a result, toner concentration control can be performed using a target output value $Vt_{ref}$ that has been corrected appropriately for each output image.

Also according to this embodiment, when modification of the target output value $Vt_{ref}$ by the first target output value correcting means and modification of the target output value $Vt_{ref}$ by the second target output value correcting means are to be performed at an identical timing, modification of the target output value $Vt_{ref}$ by the first target output value correcting means is not performed. As described above, the reason for this is that the second target output value correcting means are capable of correcting the target output value $Vt_{ref}$ when a deviation occurs in the toner concentration of the reference toner pattern, regardless of the cause thereof, and therefore more stable image output is possible.

Also according to this embodiment, by applying the present invention as an image density control method in a laser printer serving as an image forming apparatus comprising the photosensitive body 11 for carrying a latent image, the development device 20 for developing the latent image on the photosensitive body 11 into a toner image using a developer containing a toner and a magnetic carrier, the powder pump 27 for supplying replenishment toner to the development device 20, the permeability sensor 26 for detecting and outputting the toner concentration of the two-component developer in the development device 20, the control portion 100 for controlling the toner concentration in the development device 20 in accordance with the target output value $Vt_{ref}$ that is referenced in order to control the toner concentration, the intermediate transfer belt 6 provided in a position contacting the photosensitive body 11 and stretched by a plurality of stretching members, and the reflection concentration sensor 62 for detecting a toner pattern formed on the intermediate transfer belt 6, the amount of toner consumed for a purpose other than image formation can be suppressed, and variation in the development ability of the development device 20 due to environmental variation and the like can be dealt with so that a constant image density can be obtained.

In this embodiment, an intermediate transfer type laser printer is used, but the present invention is not limited thereto, and a direct transfer type image forming apparatus, in which a toner image is transferred from the photosensitive body 11 directly onto a transfer sheet carried and conveyed by a transfer conveyance belt, may be used. When continuous printing is performed in this case, a toner pattern may be formed between sheets, or in other words on a part of the transfer conveyance belt between the rear end portion of a leading sheet carried and conveyed by the transfer conveyance belt and the tip end portion of a following sheet.

Further, the potential control means may be used instead of the second target output value correcting means such that the target output value $Vt_{ref}$ is corrected by the first target output value correcting means and the potential control means. Alternatively, the potential control means may be used together with the first target output value correcting means and second target output value correcting means such that the target output value $Vt_{ref}$ is corrected using the respective advantages of each.

According to the present invention, the amount of toner that is consumed for a purpose other than image formation can be suppressed, and an appropriate image density can be obtained even when the development ability of a development device varies due to environmental variation and the like.

Various modifications will become possible for those skilled in the art after receiving the teachings of the present disclosure without departing from the scope thereof.

What is claimed is:

1. An image forming apparatus comprising:

an image carrier for carrying a latent image;

a development device for developing the latent image on the image carrier into a toner image using a developer containing a toner and a magnetic carrier;

a toner replenishment device for supplying replenishment toner to the development device;

toner concentration detecting means for detecting a toner concentration of the two-component developer in the development device;

toner concentration control means for controlling the toner concentration in the development device in accordance with a toner concentration control reference value that is referenced in order to control the toner concentration;

a belt member provided in a position contacting the image carrier and stretched by a plurality of stretching members;

toner pattern detecting means for detecting a toner pattern formed on the belt member;

information detecting means for detecting information for learning a toner replacement amount in the development device over a predetermined time period;

first toner concentration control reference value modifying means for modifying the toner concentration control reference value on the basis of a detection result of the information detecting means; and second toner concentration control reference value modifying means for modifying the toner concentration control reference value on the basis of a detection result of the toner pattern detecting means, wherein the first toner concentration control reference value modifying means and the second toner concentration control reference value modifying means operate in conjunction to modify the same toner concentration control reference value, and wherein an interval at which the second toner concentration control reference value modifying means modifies the toner concentration control reference value is varied in accordance with the toner replacement amount.

2. The image forming apparatus as claimed in claim 1, wherein the first toner concentration control reference value modifying means modifies the toner concentration control reference value at a first timing interval and the second toner concentration control reference value modifying means modifies the toner concentration control reference value at a second timing interval which differs from the first timing interval.

3. The image forming apparatus as claimed in claim 1, wherein the information detecting means are image area ratio detecting means for detecting an image area ratio of images formed within the predetermined time period.

4. The image forming apparatus as claimed in claim 3, wherein the first toner concentration control reference value modifying means modifies the toner concentration control reference value on the basis of an average value of the image area ratio of the images formed within the predetermined time period, which is obtained from a detection result of the image area ratio detecting means.

5. The image forming apparatus as claimed in claim 3, wherein the first toner concentration control reference value modifying means modifies the toner concentration control reference value on the basis of a moving average value of the image area ratio of the images formed within the predetermined time period, which is obtained from a detection result of the image area ratio detecting means.

6. The image forming apparatus as claimed in claim 5, wherein the moving average value M (i) is calculated on the basis of the following formula:

$$M(i)=(1/N)\times\{M(i-1)\times(N-1)+X(i)\}$$

where "N" is a sampled number of image area ratios, "M (i−1)" is a previously calculated moving average value, and "X(i)" is a current detected image area ratio.

7. The image forming apparatus as claimed in claim 1, wherein the first toner concentration control reference value modifying means modifies the toner concentration control reference value on the basis of a detection result of the information detecting means so as to reduce the toner concentration when the toner replacement amount in the development device over the predetermined time period is greater than a reference amount and so as to increase the toner concentration when the toner replacement amount in the development device over the predetermined time period is smaller than the reference amount.

8. The image forming apparatus as claimed in claim 1, wherein, when the toner replacement amount is larger than a first predetermined threshold and smaller than a second predetermined threshold, the interval at which the second toner concentration control reference value modifying means modifies the toner concentration control reference value is shortened in comparison with all other cases.

9. The image forming apparatus as claimed in claim 1, wherein the first toner concentration control reference value modifying means modifies the toner concentration control reference value from the end of a previous image creation operation to the beginning of a following image creation operation.

10. The image forming apparatus as claimed in claim 9, wherein, wherein the first toner concentration control reference value modifying means modifies the toner concentration control reference value at a first timing interval and the second toner concentration control reference value modifying means modifies the toner concentration control reference value at a second timing interval, and when a timing of modification of the toner concentration control reference value by the first toner concentration control reference value modifying means and modification of the toner concentration control reference value by the second toner concentration control reference value modifying means coincides, modification of the toner concentration control reference value by the first toner concentration control reference value modifying means is not performed.

11. An image forming apparatus comprising:

an image carrier for carrying a latent image;

a development device for developing the latent image on the image carrier into a toner image using a developer containing a toner and a magnetic carrier;

a toner replenishment device for supplying replenishment toner to the development device;

a toner concentration detecting unit configured to detect a toner concentration of the two-component developer in the development device;

a toner concentration control unit configured to control the toner concentration in the development device in accordance with a toner concentration control reference value that is referenced in order to control the toner concentration;

a belt member provided in a position contacting the image carrier and stretched by a plurality of stretching members;

a toner pattern detecting unit configured to detect a toner pattern formed on the belt member;

an information detecting unit configured to detect information for learning a toner replacement amount in the development device over a predetermined time period;

a first toner concentration control reference value modifying unit configured to modify the toner concentration control reference value on the basis of a detection result of the information detecting unit; and a second toner concentration control reference value modifying unit configured to modify the toner concentration control reference value on the basis of a detection result of the toner pattern detecting unit, wherein the first toner concentration control reference value modifying unit and the second toner concentration control reference value modifying unit operate in conjunction to modify the same toner concentration control reference value, and wherein an interval at which the second toner concentration control reference value modifying unit modifies the toner concentration control reference value is varied in accordance with the toner replacement amount.

12. A method, implemented on an image forming apparatus having an image carrier for carrying a latent image and a belt member provided in a position contacting the image carrier and stretched by a plurality of stretching members, comprising:

developing, at a development device, the latent image on the image carrier into a toner image using a developer containing a toner and a magnetic carrier;

supplying, at a toner replenishment device, replenishment toner to the development device;

detecting, at a toner concentration detecting unit, a toner concentration of the two-component developer in the development device;

controlling, at a toner concentration control unit, the toner concentration in the development device in accordance with a toner concentration control reference value that is referenced in order to control the toner concentration;

detecting, at a toner pattern detecting unit, a toner pattern formed on the belt member;

detecting, at an information detecting unit, information for learning a toner replacement amount in the development device over a predetermined time period;

modifying, at a first toner concentration control reference value modifying unit, the toner concentration control reference value on the basis of a detection result of the information detecting unit; and modifying, at a second toner concentration control reference value modifying unit, the toner concentration control reference value on the basis of a detection result of the toner pattern detecting unit, wherein the first toner concentration control reference value modifying unit and the second toner concentration control reference value modifying unit operate in conjunction to modify the same toner concentration control reference value, and wherein an interval at which the second toner concentration control reference value modifying unit modifies the toner concentration control reference value is varied in accordance with the toner replacement amount.

* * * * *